US005901596A

United States Patent [19]

Tetzloff et al.

[11] Patent Number: 5,901,596

[45] Date of Patent: May 11, 1999

[54] TUBE BENDER LOADER AND UNLOADER

[75] Inventors: Roger L. Tetzloff, Sturgis; Michael T. Morris, Coldwater, both of Mich.

[73] Assignee: Burr Oak Tool and Gauge Company, Inc., Sturgis, Mich.

[21] Appl. No.: 09/062,459

[22] Filed: Apr. 17, 1998

[51] Int. Cl.[6] ..... B21C 47/00; B21D 43/00; B21D 45/00

[52] U.S. Cl. ..... 72/134; 72/419; 72/426

[58] Field of Search ..... 72/133, 134, 149, 72/426, 427, 428, 169, 250, 419, 420

[56] References Cited

U.S. PATENT DOCUMENTS 5,090,191 2/1992 Mueller ..... 57/275
5,379,624 1/1995 Harman et al. ..... 72/149

*Primary Examiner*—Joseph J. Hail, III
*Assistant Examiner*—Rochey Butler
*Attorney, Agent, or Firm*—Flynn, Thiel, Boutell & Tanis, P.C.

[57] ABSTRACT

A tube bending apparatus having a base and a bend arbor thereon and an X-axis extending spindle selectively rotatably mounted on the base for movement along the X-axis and for lateral movement in orthogonal Y-axis and Z-axis directions. The spindle has a clamping mechanism on the distal end thereof. A tube bend effecting arm is hinged relative to the bend arbor and is swingable about a bend axis. An elongate track is provided laterally offset from the base and extends continuously in a direction parallel to the X-axis. A tube loader is mounted on and for movement along the elongate track. The tube loader includes a feed mechanism for sequentially feeding one tube at a time to a specified position axially aligned with the spindle when in either of the first and second locations of the tube loader. Additionally, a method is provided for systematically removing a bent tube from a bend arbor utilizing onboard robotics of the tube bending apparatus and an onboard tube gripping tool operatively connected to the spindle.

14 Claims, 6 Drawing Sheets

TUBE BENDER LOADER AND UNLOADER

FIELD OF THE INVENTION

This invention relates to a tube bender loading and unloading apparatus and, more particularly, to a tube bender loader for selectively delivering tubes to be bent to either one of two tube loading stations on the tube bending apparatus and an unloader using onboard robotics of the tube bending apparatus.

BACKGROUND OF THE INVENTION

The tube bending apparatus disclosed in this application is conventional. The tube bending apparatus includes a pair of spaced tube loading stations, one on each of two opposite sides of a bending arbor. Each tube loading station is utilized for different tube bending operations. Heretofore, separate tube loaders have been provided for effecting a delivery of tubes to the respective two tube loading stations one at a time for processing by the tube bending apparatus. This has involved a considerable amount of set up time, particularly to orient the tube loader at precisely the correct location in order to supply tubes to be bent to each of the respective tube loading stations. Thus, there is a need to minimize the amount of down time when it is desired to switch from one tube loading station to an other tube loading station.

Another feature of the invention relates to the bending of a heretofore supplied tube about a bend arbor, the configuration of the bent tube after all of the bends have been placed into the tube being such that the tube cannot conveniently be removed from the bend arbor. Heretofore, separate robotics have been employed for effecting an automatic removal of the bent tube from the bend arbor or manual unloading is performed by an operator of the apparatus. The provision of separate robotics is expensive and the set up time required for mating the robotics with the tube bending apparatus is considerable. Further, separate robotics occupy valuable floor space around the tube bending apparatus thereby minimizing the amount of free space for personnel to move about the tube bending apparatus. Further, it is also preferred to keep operator personnel away from moving machinery. Thus, there is a need for providing a mechanism for effecting a removal of a bent tube on a bend arbor without employing separate robotics or operator assistance.

Accordingly, it is an object of the invention to provide a tube bending apparatus which includes a tube loader capable of serving either one of two tube loading stations on the tube bending apparatus.

It is a further object of the invention to provide a tube bending apparatus, as aforesaid, wherein the tube loader is physically movable on a guide between the two tube loading stations.

It is a further object of the invention to provide a tube bending apparatus, as aforesaid, wherein the tube loader includes adjustable features for facilitating a precise control of the location whereat a tube is delivered from a tube supply to a location operatively associated with a spindle on the tube bending apparatus.

It is a further object of the invention to provide a bent tube unloading apparatus utilizing the onboard spindle of the tube bending apparatus.

It is a further object of the invention to provide a bent tube unloader, as aforesaid, wherein a separate gripping tool is provided on the tube bending apparatus, which tool is adapted to be attached to the spindle and moved by the spindle to a location whereat the bent tube on the bend arbor is located so that the tool can be utilized to grip the bent tube and be moved by the spindle to effect a removal of the bent tube from the bend arbor and a delivery thereof to a location whereat the tool releases its grip with the bent tube.

It is a further object of the invention to provide a tube bending apparatus with an associated tube loader that is capable of repeatedly accurately supplying tubes to be bent to a precise location whereat the spindle on the tube bender is able to grip the tube and effect a movement of it to a prescribed location whereat a bending operation can begin on the tube.

SUMMARY OF THE INVENTION

In general, the objects and purposes of the invention are met by providing a tube bending apparatus having a base and a bend arbor thereon and an X-axis extending spindle selectively rotatably mounted on the base for movement along the X-axis and for lateral movement in orthogonal Y-axis and Z-axis directions. The spindle has a clamping mechanism on the distal end thereof. A tube bend effecting arm is hinged relative to the bend arbor and is swingable about a bend axis. The spindle is movable along the X-axis to a first position wherein a distal end of the spindle is substantially spaced from the bend arbor so as to define a first tube loading station between the first position of the spindle and the bend arbor. The spindle is also movable along the X-axis to a second position through the first tube loading station whereat the distal end of the spindle is oriented adjacent the bend arbor, and a region oriented axially of the distal end on a side of the bend arbor remote from the first tube loading station defines a second tube loading station. An elongate track is provided laterally offset from the base and extends continuously in a direction parallel to the X-axis to first and second locations along side of the first and second tube loading stations, respectively. A tube loader is mounted on and for movement along the elongate track to and between the first and second locations. The tube loader includes a feed mechanism for sequentially feeding one tube at a time to a specified position axially aligned with the spindle when in either of the first and second locations of the tube loader.

The objects and purposes of the invention are additionally met by providing a method for systematically removing a bent tube from a bend arbor utilizing onboard robotics of the tube bending apparatus and an onboard tube gripping tool operatively connected to the spindle.

BRIEF DESCRIPTION OF THE DRAWINGS

Further objects and purposes of this invention will be apparent to persons acquainted with apparatus of this general type upon reading the following specification and inspecting the accompanying drawings, in which.

DETAILED DESCRIPTION

Figure 1:
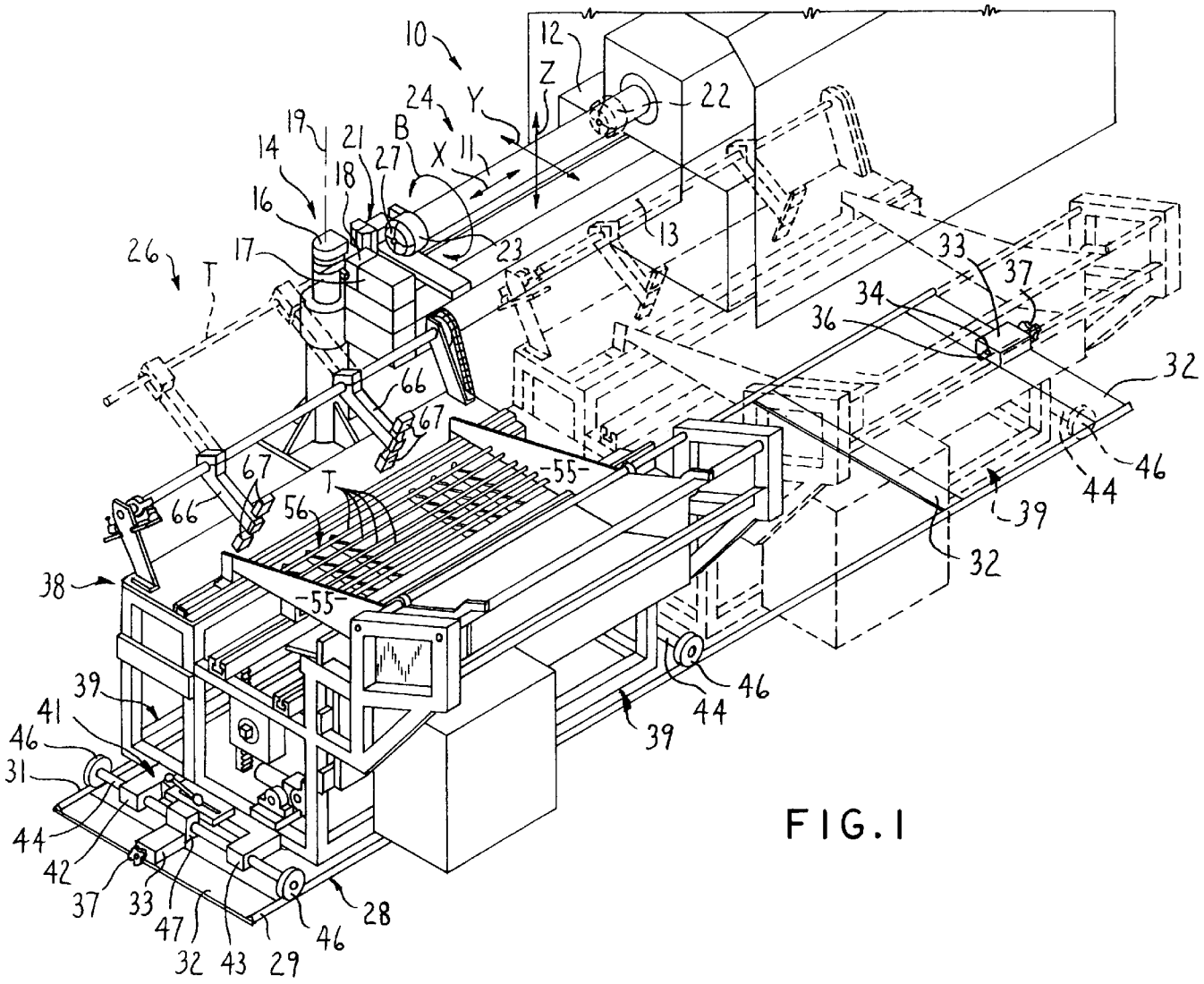
FIG. 1 is an isometric view of a combination of a tube bending apparatus and associated tube loader embodying the invention.

Certain terminology will be used in the following description for convenience in reference only and will not be limiting. The words "up", "down", "right" and "left" will designate directions in the drawings to which reference is made. The words "in" and "out" will refer to directions toward and away from, respectively, the geometric center of the device and designated parts thereof. Such terminology will include the words above specifically mentioned, derivatives thereof and words of similar import.

In FIG. 1, the reference numeral 10 designates a conventional tube bending apparatus. The tube bending apparatus 10 includes a spindle 11 that is supported on a base 12 for movement in three orthogonally related directions, namely, an X-axis direction X, a Y-axis direction Y and a Z-axis direction Z, all indicated by arrows marked, respectively, X, Y and Z. In addition, the spindle is adapted to be selectively rotated in opposite directions as represented by the arrow B. A beam 13 is cantilevered outwardly from the base 12 to a tube bending device 14 which includes a bend arbor 16 around which is a tube to be bent and a bend arm 17 hinged to the bend arbor 16. The bend arm 17 includes a tube gripper 18 for engaging the sidewall of the tube to be bent and for guiding the tube to be bent around the bend arbor 16 and about a bend axis 19 to form a bend in the tube T. A gripping tool 21 is also provided adjacent the distal end of the cantilevered beam 13.

As is illustrated in FIG. 1, the spindle 11 is movable to and to any position between a pair of positions, namely, a first position 22 illustrated in broken lines and a second position 23 illustrated in solid lines. The region between the spindle 11 when in the position 22 and the bend arbor 16 defines a first tube loading station 24. A second tube loading station 26 is generally oriented along the X-axis but on a side of the bend arbor 16 remote from the first tube loading station 24.

In this particular embodiment, the distal end of the spindle 11 includes a conventional clamping mechanism 27 for facilitating a gripping of a tube T supplied to either one of the two tube loading stations 24 or 26. The tube clamping mechanism 27 generally is composed of plural clamp members 25 radially movably mounted on the spindle 11, the clamp members 25 each being drivable in a radial direction to either effect a clamping of a tube T between the respective clamp members or a release of a tube T.

An elongate track 28 is oriented laterally along side of the base 12 and extends generally parallel to the X-axis direction to and between positions adjacent the first tube loading station 24 and second tube loading station 26. The track 28 is composed of two parallel rails 29 and 31 joined at several locations along their respective lengths by plate-like members 32. The two plate-like members 32 adjoining the respective ends of the rails 29 and 31 each have an abutment member 33 weldably secured thereto. Each of the abutment members 33 have a hole 34 extending therethrough in a direction parallel to the X-axis and in which is received an externally threaded bolt 36 projecting from one side of the abutment members 33 and having an enlarged head 37 on one end thereof manually accessible on the other side of the abutment members 33.

Figure 2:
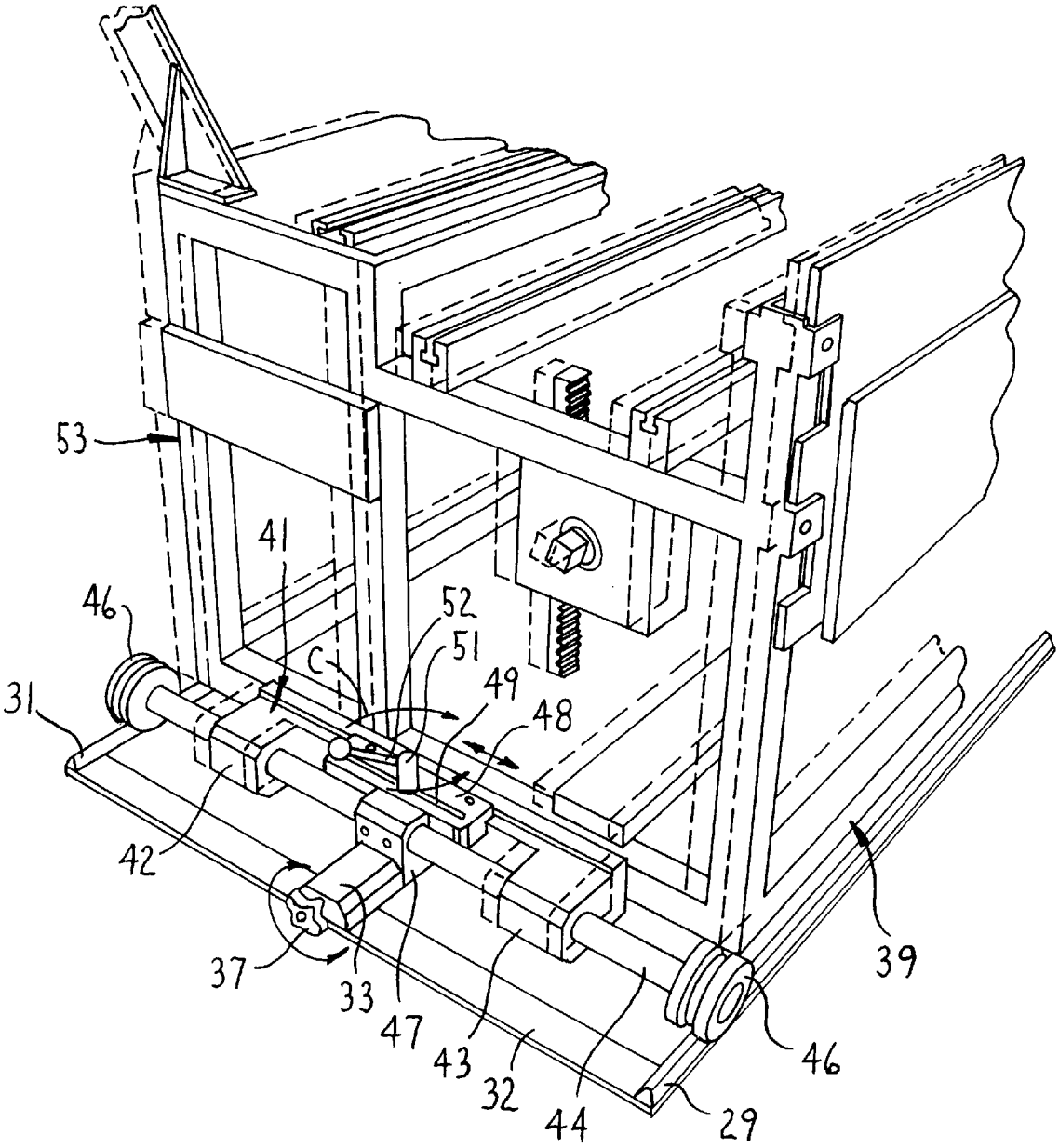
FIG. 2 is an enlarged fragment of FIG. 1.

A conventional tube loader 38 is provided for delivering a tube T one at a time to a position as shown in broken lines in FIG. 1 axially aligned with the X-axis of the spindle 11. The unique part of the tube loader is the provision of a carriage 39 on which the conventional tube loader 38 is mounted, the carriage 39 having a U-shaped bearing yoke 41 secured to opposite ends of the carriage 39 and having axially aligned holes in the legs 42 and 43 of the yoke through which is received an axle 44 having wheels 46 rotatably supported at the opposite ends of each thereof. The wheels 46 are appropriately flanged as illustrated in FIG. 2 so as to be guided by the rails 29 and 31. In this particular embodiment, the bearing yokes 41 are adapted to slide axially along the axles 44. Since the bearing yokes 41 are secured to the carriage 39, this means that the carriage 39 is shiftable laterally of the elongate track 28 between the solid line position illustrated in FIG. 2 and the broken line position. The purpose of this feature will be explained in more detail below.

A stop block 47 is fixedly attached to each axle 44. Each stop block 47 has an internally threaded hole oriented to be axially aligned with the holes 34 in the abutment members 33 and the axis of the bolts 36 therein. The holes in the stop blocks 47 are internally threaded and adapted to threadedly receive the bolts 36 in the respective ones thereof. For example, when the tube loader 38 is in the position illustrated in solid lines in FIGS. 1 and 2, the bolts 36 are threadedly engaged in the holes in the respective stop block 47 to hold the stop block 47 into firm engagement against and with the abutment member 33.

A gauge plate 48 is secured to the bearing yoke 41 and has an elongated, laterally extending, slot 49 therein through which extends an upstanding externally threaded stud (not shown) secured to the stop block 47. An internally threaded cap nut 51 with a handle 52 thereon is coupled to the stud to effect, when the cap nut 51 is tightened onto the stud, a locking of the bearing yoke 41 to the stop block 47. If desired, gradations (not shown) may be provided on the gauge plate 48 so that an operator will be able to determine the precise location to which the carriage 39 may be adjusted laterally. The handle 52 is adapted to be manually engaged and rotated in the direction of the arrow C (FIG. 2) in order to effect a loosening or a tightening of the cap nut 51 relative to the gauge plate 48.

Figure 3:
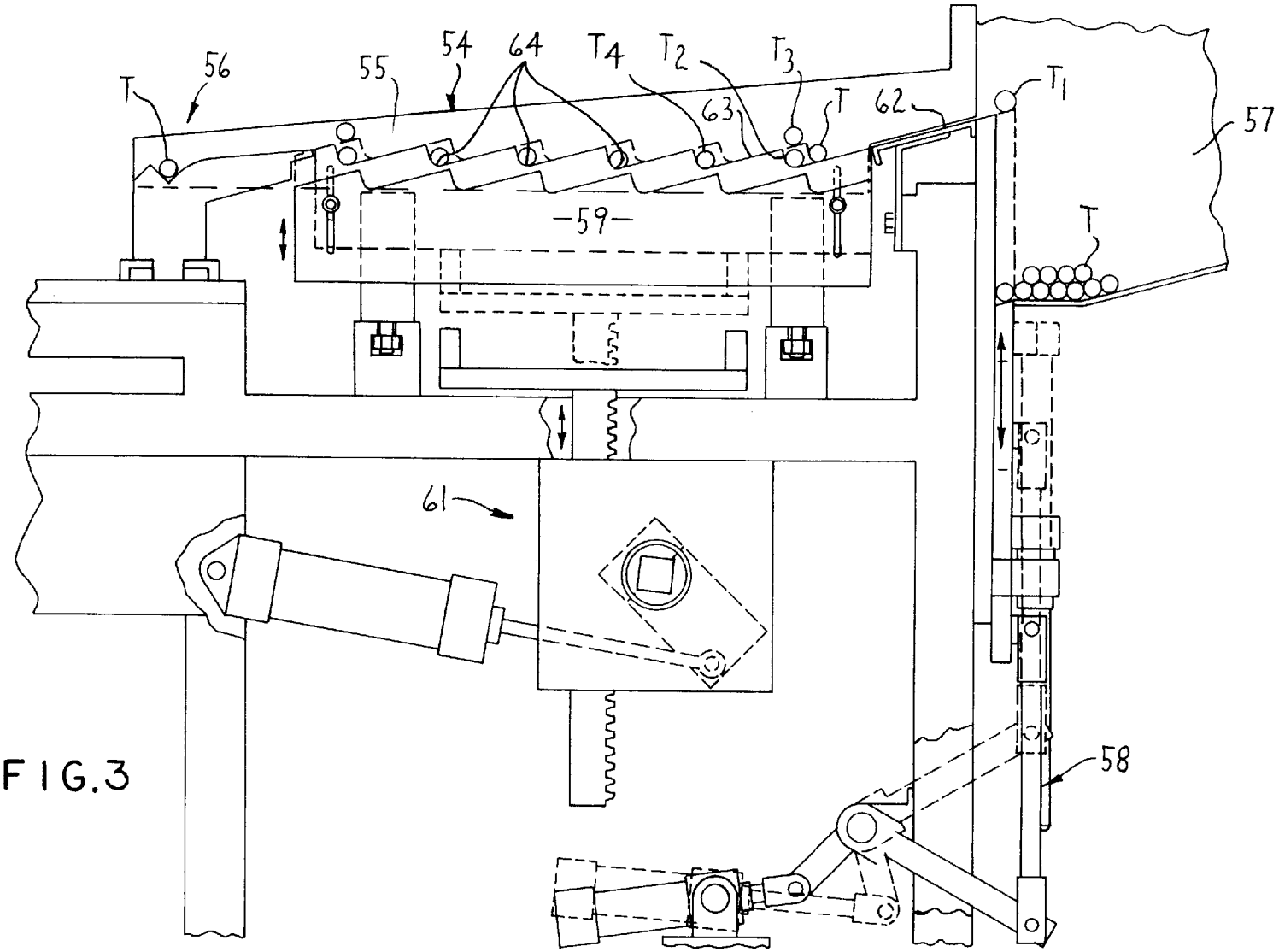
FIG. 3 is an enlarged end view of FIG. 2.
Figure 4A:
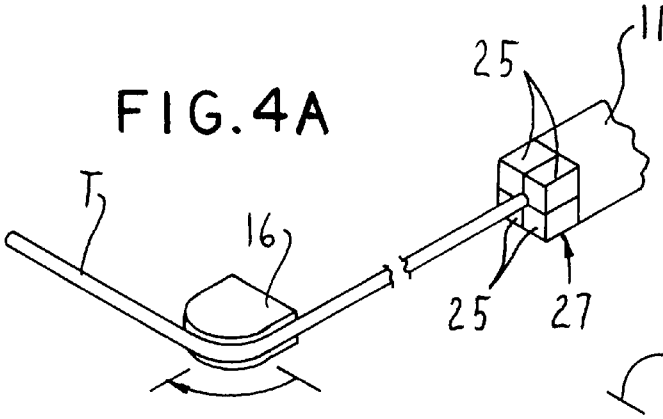
FIGS. 4A–4G illustrate various stages of bending a tube about a bend arbor.
Figure 4B:
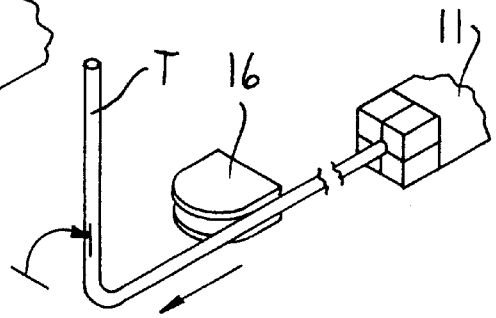
Figure 4C:
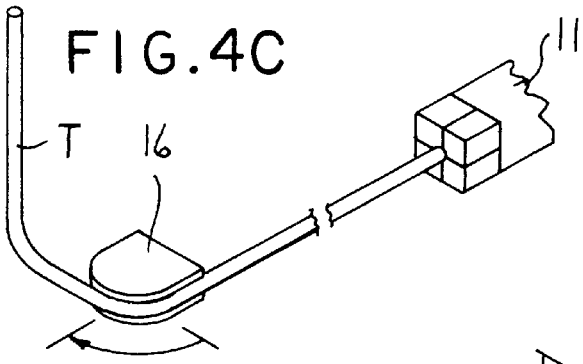
Figure 4D:
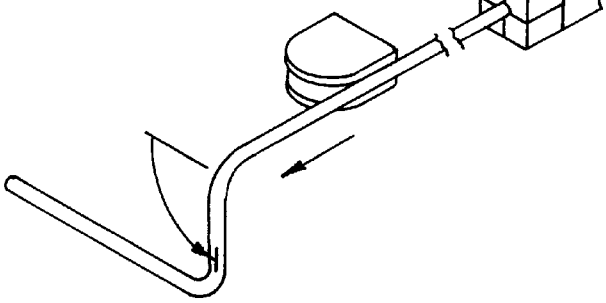
Figure 4E:
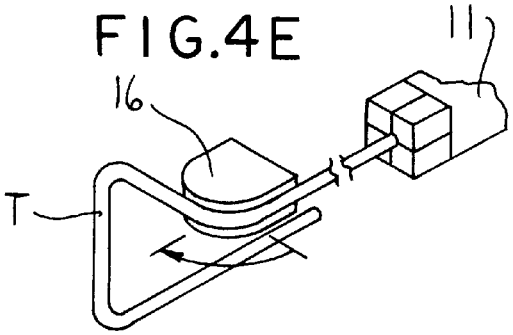
Figure 4F:
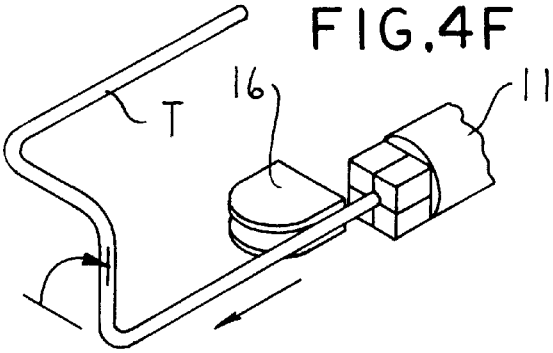
Figure 4G:
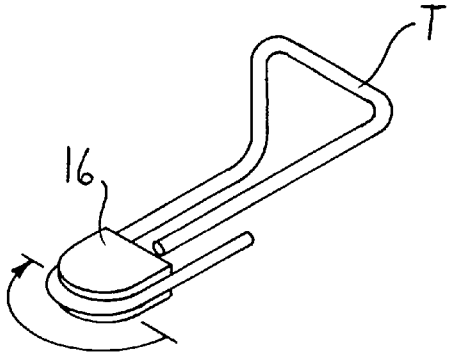

A frame 53 is provided on the carriage 39 and supports a conventional type of walking beam conveyor mechanism 54 (FIG. 3) for effecting the delivery, one at a time, of a tube T to a tube pick up location 56 (FIG. 3) and between guide plates 55 which are adjustable toward and away from one another. Both guide plates 55 are movable in the X-axis direction while maintaining the parallel relationship between them. The guide plate 55 closest to the bend arbor 16 controls the critical positioning of the end of the tube T delivered by the loader 38 to the position adjacent the bend arbor 16. Since the tube conveyor mechanism 54 is of a conventional construction, except for the adjustable feature of both guide plates 55, little will be said about it other than to point out that a plurality of tubes T are placed into a tube hopper 57 and thereafter one tube T at a time is lifted by a lifting mechanism 58 out of the tube hopper 57 to a position $T_1$, the tube $T_1$ thereafter rolling down a ramp 62 to a position $T_2$. Thereafter, a lifting beam 59 is lifted by a further lifting mechanism 61 to lift a tube at tube position $T_2$ to position $T_3$ so that it can roll down a further ramp 63 to tube position $T_4$. A sequential lifting and lowering of the lifting beam 59 by the lifting mechanism 61 will cause tubes to become oriented in each of the tube troughs 64 in the conveyor mechanism 54 so that eventually one tube T will be delivered to the tube pick up location 56. Thereafter, a pair of arms 66 (FIG. 1), each having a pair of tube grippers 67 thereon are activated to close the grippers 67 about the tube T at the pick up location 56 and effect a movement thereof with a tube to the broken line position illustrated in FIG. 1 wherein the tube becomes axially aligned with the X-axis of the spindle 11. In this location, the tube T is oriented immediately adjacent the bend arbor 16 and in between the aforesaid bend arbor 16 and the tube gripper 18 on the bend arm 17. The spindle 11 may then be advanced to the left in direction of the X-axis so that the clamping mechanism 27 can engage the peripheral surface of the tube T and draw the tube T to the right toward the second position 22 of the spindle 11. Thereafter, a variety of bend operations as illustrated in FIGS. 4A–4G can be performed on the tube T in a well known manner.

If desired, the multitude of bending operations illustrated in FIGS. 4A–4G can be performed while utilizing a tube mandrel having a bend mandrel thereon (both of which are not illustrated) so as to maintain the integrity of the tube as it is bent about the bend arbor 16. A conventional tube mandrel with a bend mandrel thereon is illustrated as at 13 and 17, respectively, in U.S. Pat. No. 5,379,624, and reference thereto is to be incorporated herein by reference. Thus, and in this particular situation, the tube T would be sleeved over the bend mandrel when the tube is drawn to the right toward the first position 22 of the spindle 11. When the bend mandrel is in place, it is not possible to load the tube bending apparatus 10 at the tube loading station 24. Instead, all tube loading must occur at the tube loading station 26.

When a situation arises when a bend mandrel is not required, it is sometimes beneficial to effect a loading of the tube bending apparatus 10 at the tube loading station 24. In order to quickly move the tube loader 38 from the solid line position illustrated in FIG. 1 to the broken line position, it is a mere simple task to undo the bolt 36 threadedly attached at the left end of the tube loader so as to free the engagement of the stop block 47 with the abutment member 33 and thereafter roll the tube loader 38 on the track engaging wheels 46 to the broken line position and when thereat effect a securement of the bolt 36 with the stop block 47 at the opposite end of the carriage 39.

When different size or diameter tubing T is placed into the tube hopper 57 or a different radiused bend arbor is employed, it is necessary to laterally adjust the carriage 39 so that tubes T delivered to the X-axis of the spindle 11 location indicated by the broken line position illustrated in FIG. 1 will be accurately positioned to within a specified tolerance relative to the bend arbor 16. An appropriate lateral adjustment of the X-axis of the spindle 11 can also occur by utilizing the control features on the base 12 for bringing about the orthogonally related movements in the X, Y and Z axis directions. The lateral adjustment feature of the carriage 39 is best illustrated in FIG. 2 and has been described above in detail. Thus, further comment in regard to the lateral adjustability of the carriage 39 is believed unnecessary.

Figure 5A:
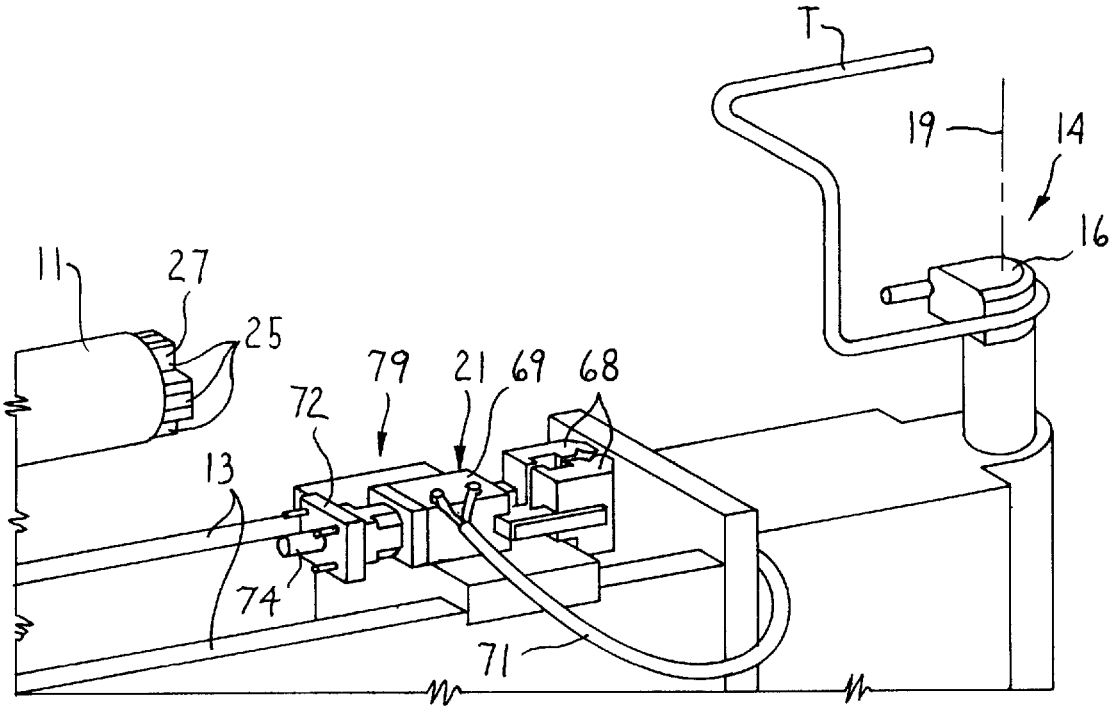
FIGS. 5A–5D illustrate a tube gripping tool provided on the tube bending apparatus and capable of being operatively connected to the spindle on the tube bending apparatus to facilitate removal of a bent tube from the bend arbor.
Figure 5B:
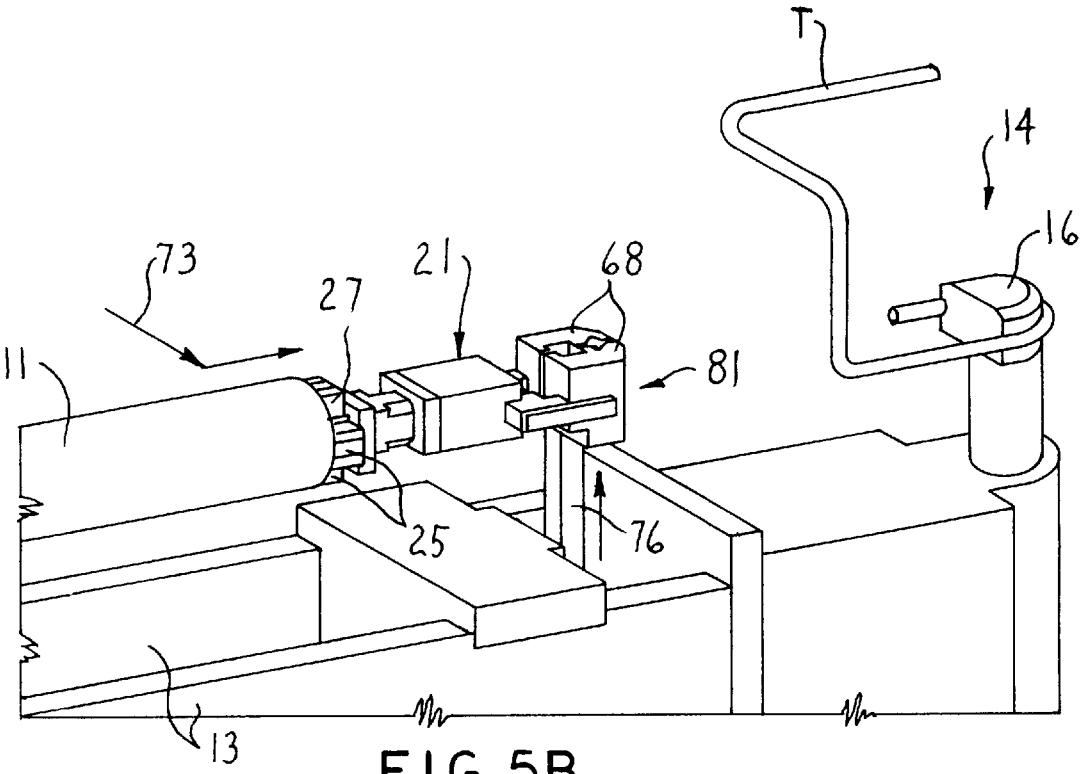
Figure 5C:
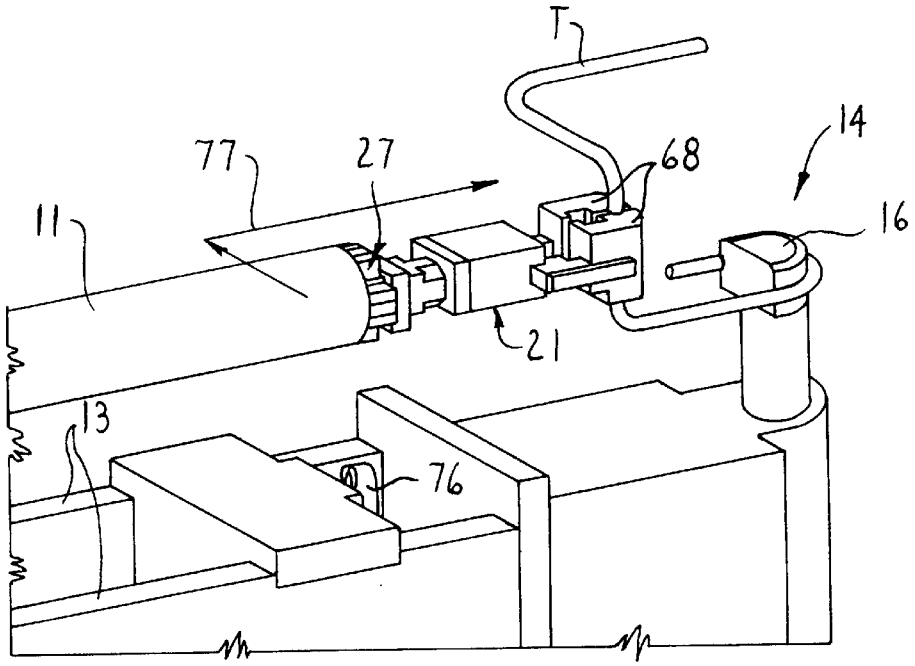
Figure 5D:
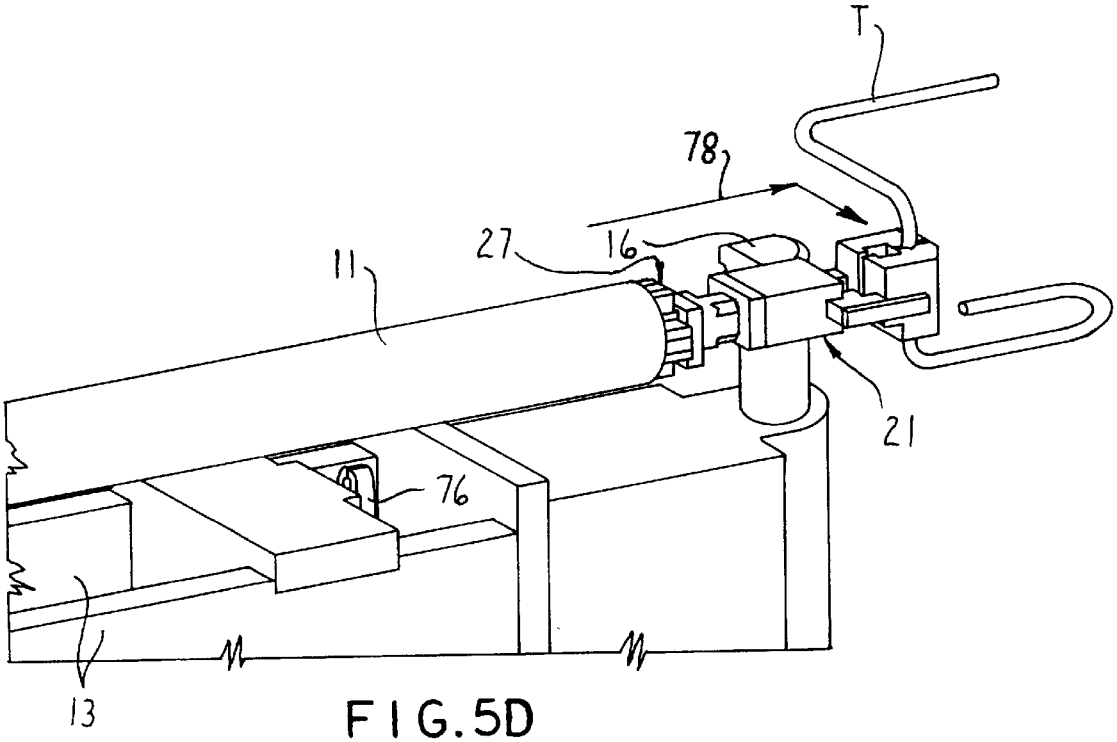

It sometimes occurs that the multitude of bending operations illustrated in FIGS. 4A–4G result in a bent configuration on the bend arbor 16 such that the tube T must be removed manually or by robotics from the bend arbor 16. FIGS. 5A–5D illustrate a mechanism for facilitating an easy removal of a complexly configured bent tube T on the bend arbor 16. As stated above, a tube gripping tool 21 is provided on the cantilevered beam 13. The tube gripping tool 21, normally stored in a tool storing position 79 depicted in FIG. 5A, includes a pair of gripping jaws 68 driven toward and away from one another by pneumatically controlled circuitry inside a valve housing 69 to which pressurized air is supplied through hoses 71. Conventional control circuitry (not shown) sequentially control the operation of the jaws 68 in a well-known manner. The end of the tube gripping tool 21 remote from the jaws 68 includes a coupling structure 72 adapted to be coupled to the clamping mechanism 27 on the distal end of the spindle 11. Thus, and through an appropriate manipulation of the location of the X-axis of the spindle 11 in the direction of the arrows 73 in FIG. 5B during the last bend operation performed on the tube T, the axis of the spindle 11 is oriented coaxially with the axis of an X-axis extending peg 74 on the coupling structure 72. In addition, a reciprocal rod 76 is provided and to which is clamped the jaws 68 of the tube gripper 21, when the tube gripping tool is not in use, so as to locate the tube gripping tool 21 in a more conveniently available spindle coupling position 81 relative to the spindle 11 as best illustrated in FIG. 5B. Thereafter, pneumatic circuitry controls the operation of the jaws 68 to facilitate a separation of them from the reciprocal rod 76 so that the spindle can thereafter move in the direction of the arrows 77 (FIG. 5C) to bring the jaws 68 into juxtaposition a section of the tube T spaced from the bend arbor 16. Thereafter, the pneumatic circuitry can effect the closing of the jaws 68 so that the tube T is gripped therebetween and subsequently the spindle 78 can be appropriately moved in direction of the arrows 78 to facilitate a removal of the complexly formed tube T from the bend mandrel 16 and delivered to an appropriate bend tube release location illustrated in FIG. 5B whereat the tube T can be released and dropped into an available container or conveyor (not shown). As is illustrated in FIGS. 5C and 5D, the rod 76 is moved to its retracted position so as to be out of the way of any further movement of the spindle 11 in facilitating a removal of the bend tube T from the bend arbor 16. Thus, and by utilizing the onboard spindle 11, it is no longer necessary to utilize separate robotics to affect the removal of the bent tube T from the bend arbor 16. The tube gripping tool 21 is thereafter returned to the initial position thereof, during the time that a new tube T to be bent is delivered to the specified location in one of the two tube loading stations 24 and 26, and reattached to the rod 76 to facilitate storage of the tool 21 in the storing position 79. If desired, weight sensing safety mats (not shown) can be placed between the rails 29 and 31 and in the area of the floor around the bend arbor 16 so that if operator personnel step on them, the entire tube bending apparatus 10 and tube loader mechanism 38 will shut down.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a tube bending apparatus having a base with a bend arbor thereon and an X-axis extending spindle selectively rotatably mounted on said base for movement along said X-axis and for lateral movement in orthogonal Y-axis and Z-axis directions relative to said bend arbor, said bend arbor defining a bend axis extending perpendicular to a plane defined by the X and Y axes, said spindle having a clamping mechanism at a distal end thereof, a tube bend effecting arm hinged relative to said bend arbor and swingable about said bend axis, said spindle being movable along said X-axis to a first position thereof wherein a distal end of said spindle is substantially spaced from said bend arbor so as to define a first tube loading station between said first position of said spindle and said bend arbor, said spindle being movable along said X-axis to a second position thereof through said first tube loading station whereat said distal end of said spindle is oriented adjacent said bend arbor, and a region oriented axially of said distal end and on a side of said bend arbor remote from said first tube loading station defining a second tube loading station, the improvement comprising:

an elongate track laterally offset from said base and extending continuously in a direction parallel to said X-axis to first and second locations along side of said first and second tube loading stations, respectively;

a tube loader mounted on and for movement along said elongate track to and between said first and second locations, said tube loader including a tube feed mechanism for sequentially feeding one tube at a time to a specified position axially aligned with said spindle when in either of said first and second locations of said tube loader; and means for selectively releasably fixing said tube loader in a selected one of said first and second locations so as to render said tube loader incapable of movement in said X-axis direction along said elongate track.

2. The tube bending apparatus according to claim 1, wherein said tube loader includes a carriage, said carriage including track engaging means for facilitating said movement of said tube loader along said elongate track, and a lateral adjustment mechanism for facilitating a lateral adjustable movement of said carriage relative to said elongate track so as to facilitate said feed mechanism feeding said one tube to within a specified tolerance at said specified position.

3. The tube bending apparatus according to claim 1, wherein said base has a tool storing region thereon, a gripping tool in said tool storing region, said gripping tool having two relatively movable jaws and means for driving said jaws between open and closed positions, said gripping tool additionally having a coupling means thereon operatively connectable to said clamping mechanism on said spindle, whereby said gripping tool, when connected to said clamping mechanism, is moved by said spindle to a position adjacent a tube bent into a specified configuration and wrapped around said bend arbor, said jaws being sequentially opened, moved by said spindle and then closed to grip a section of said bent tube, said jaws and said bent tube thereafter moving as a unit to facilitate removal of said bent tube from said bend arbor and delivery to an area whereat said jaws open to release said bent tube.

4. The tube bending apparatus according to claim 2, wherein said tube feed mechanism also sequentially feeds said one tube to said specified position whereat one end of said one tube is oriented immediately adjacent said bend arbor; and wherein said lateral adjustment mechanism facilitates said lateral adjustment relative to said bend arbor in order to compensate for a change in diameter of at least one of said one tube and a change in a bend radius.

5. The tube bending apparatus according to claim 2, wherein said carriage includes a frame and at least a pair of spaced and parallel axles mounted on said frame and extending generally perpendicularly to said X-axis direction of said elongate track, a rotatable wheel at each end of each axle, said elongate track including a pair of parallel rails on which said wheels roll; and wherein said lateral adjustment mechanism includes said frame having slide bearings fixed thereto and axially slidably supporting respective said axles thereon and a clamping mechanism for facilitating a fixed connection of said frame to said elongate track.

6. The tube bending apparatus according to claim 2, wherein said carriage includes a frame having a tube hopper adapted to hold a plurality of tubes, and a conveyor mechanism for delivering a tube from said tube hopper one at a time to said tube feed mechanism.

7. The tube bending apparatus according to claim 3, wherein said tool storing region includes a rod to one end of which said movable jaws on said gripping tool are clamped in said closed position thereof, whereby when said clamping mechanism on said spindle is coupled to said coupling means, said jaws are thereafter opened to effect a release of said gripping tool from said rod.

8. The tube bending apparatus according to claim 3, wherein said means for driving said jaws is provided solely on said gripping tool.

9. The tube bending apparatus according to claim 7, wherein said rod is reciprocally movable between a storing position and a spindle coupling position so that said gripping tool clamped thereto will move therewith and to said spindle coupling position to facilitate connection of said coupling means to said clamping mechanism on said spindle at a location spaced from said tool storing position.

10. The tube bending apparatus according to claim 8, wherein said means for driving said jaws is pneumatically supplied and controlled separately of said spindle.

11. In a tube bending apparatus having a base with a bend arbor thereon and an X-axis extending spindle selectively rotatably mounted on said base for movement along said X-axis and for lateral movement in orthogonal Y-axis and Z-axis directions relative to said bend arbor, said bend arbor defining a bend axis extending perpendicular to a plane defined by the X and Y axes, said spindle having a clamping mechanism at a distal end thereof, a tube bend effecting arm hinged relative to said bend arbor and swingable about said bend axis to form a bent tube configuration on said bend arbor, a method for removing said bent tube configuration from said bend arbor comprising the steps of:

coupling a tube gripping tool to said spindle;

moving said spindle and said tube gripping tool as a unit to a location adjacent said bend arbor whereat a section of said bent tube configuration is thereafter gripped by said tube gripping tool; and thereafter further moving said spindle and said tube gripping tool as a unit to effect a removal of said bent tube configuration from said bend arbor and to a bent tube collection location whereat said bent tube configuration is released from its gripped engagement with said tube gripping tool.

12. The method according to claim 11, wherein said tube gripping tool is moved from a tool storing position to a spindle connection position prior to said coupling step.

13. The method according to claim 12, wherein said tube gripping tool is initially stored in a tool storing position; and wherein movement of said tube gripping tool from said tool storing position to said spindle connection position and said coupling to said spindle occurs during a last bend being added to said tube by movement of said bend arm.

14. The method according to claim 13, wherein said tube gripping tool is returned to said tool storing position during a time that a tube is delivered by a tube loader to said tube bending apparatus.

* * * * *